US007563405B2

(12) United States Patent
De Castro

(10) Patent No.: US 7,563,405 B2
(45) Date of Patent: Jul. 21, 2009

(54) SYSTEM OF GAS AND/OR GAS AND POWDERS INJECTION IN LIQUID METALS THROUGH ROTARY REFRACTORY LANCE

(75) Inventor: Marcio Moraes De Castro, Ipatinga (BR)

(73) Assignee: Insider LTDA., Minas Gerais (BR)

( * ) Notice: Subject to any disclaimer, the term of this patent is extended or adjusted under 35 U.S.C. 154(b) by 134 days.

(21) Appl. No.: 11/573,039

(22) PCT Filed: Aug. 25, 2005

(86) PCT No.: PCT/BR2005/000175

§ 371 (c)(1),
(2), (4) Date: Jan. 31, 2007

(87) PCT Pub. No.: WO2006/021066

PCT Pub. Date: Mar. 2, 2006

(65) Prior Publication Data

US 2007/0210495 A1 Sep. 13, 2007

(30) Foreign Application Priority Data

Aug. 27, 2004 (BR) ..... 8402794 U

(51) Int. Cl.
*C21C 5/32* (2006.01)

(52) U.S. Cl. ..... 266/225

(58) Field of Classification Search ..... 266/225
See application file for complete search history.

(56) References Cited

U.S. PATENT DOCUMENTS 4,109,898 A * 8/1978 Lautjarvi et al. ..... 266/225
4,426,068 A * 1/1984 Gimond et al. ..... 266/225

* cited by examiner

*Primary Examiner*—Scott Kastler
(74) *Attorney, Agent, or Firm*—Chan Law Group LLP

(57) ABSTRACT

This invention has the function of injecting gas and/or gas and powders into liquid metals using a refractory lance that is endowed with circular movement around its axis, using low values of pressure and sewage, which provides a better distribution and lower consumption of the powders, resulting in lower cost of the handled metal. The system consists of a refractory lance (7), which is endowed with a rotative junction (6), a motor-reducer (5) and a high-pressure hose (8).

1 Claim, 2 Drawing Sheets

SYSTEM OF GAS AND/OR GAS AND POWDERS INJECTION IN LIQUID METALS THROUGH ROTARY REFRACTORY LANCE

RELATED APPLICATIONS

This application claims the priority of International Application Number PCT/BR2005/000175 filed Aug. 25, 2005, which claims priority of Brazilian Application Number MU8402794-0 filed Aug. 27, 2004, and incorporated herein by reference in their entireties.

BACKGROUND OF THE INVENTION

1. Field of the Invention

This invention relates to the field of metallurgy, and more specifically to a system of injecting gas and/or gas and powders in liquid metals through a rotary refractory lance.

2. Description of the Prior Art

In the secondary refinement of metals, metallurgic handling is important for a better final quality of the product. The research for higher efficiency in the refining processes resulted in new procedures and innovations in equipments that expressively increased the final quality of the metal. For this purpose, one of the procedures, nowadays, consists of the injection of gas and/or gas and powders using refractory lances and a dragging gas. The material is injected into the recipient that contains the liquid metal, where the chemical reactions occur, promoting the reduction of the impurities. The refractory lance is endowed only with vertical motion, being its purpose, the injection and the mixture of the powder to its maximum depth, with the inconvenience that the pressure and the sewage must be high, causing deterioration of the bottom of the recipient, liquid metal overflow, and a non-homogeneous mixture of the injected powder.

This invention, attempting to resolve these problems, introduces to this refractory lance a rotation motion around its own axis, providing a better distribution of the powder with less agitation on the bathing surface, eliminating the overflow and the deterioration of the bottom of the recipient due to minor values of pressure and sewage.

SUMMARY OF THE INVENTION

The present invention provides a system of gas and/or gas and powders injection in liquid metals through rotary refractory lance that includes a refractory lance endowed with circular movement around its axis, executed through a rotational junction, a motor-reducer, and a high-pressure hose, for the conduction of the gas and/or gas and powder into the recipient with liquid metal.

These and other features and advantages of this invention will become further apparent from the detailed description and accompanying figures that follow. In the figures and description, numerals indicate the various features of the invention, like numerals referring to like features throughout both the drawings and the description.

DETAILED DESCRIPTION OF THE PREFERRED EMBODIMENT(S)

Figure 1:
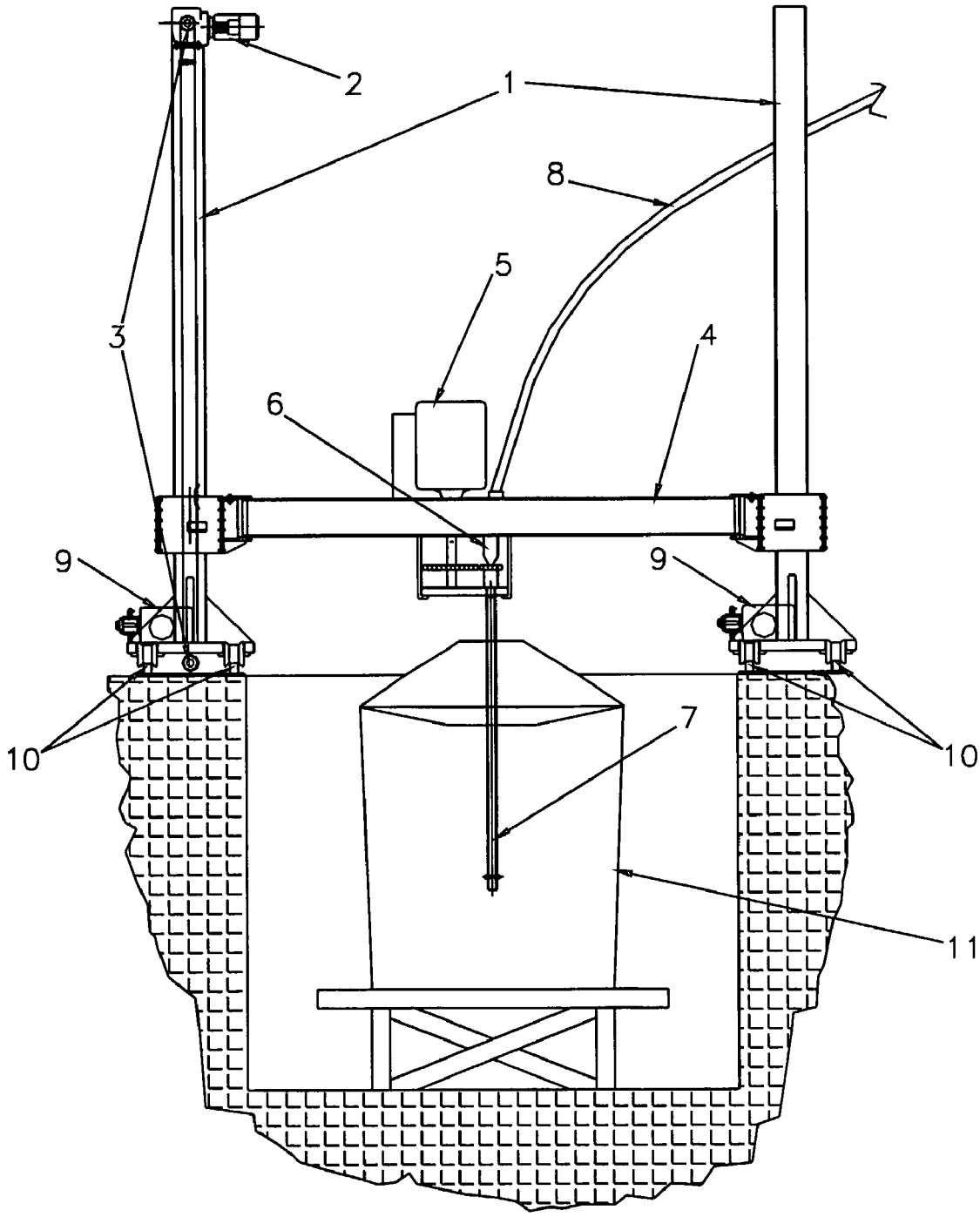
FIG. 1 shows the system front view with the pit in section.
Figure 2:
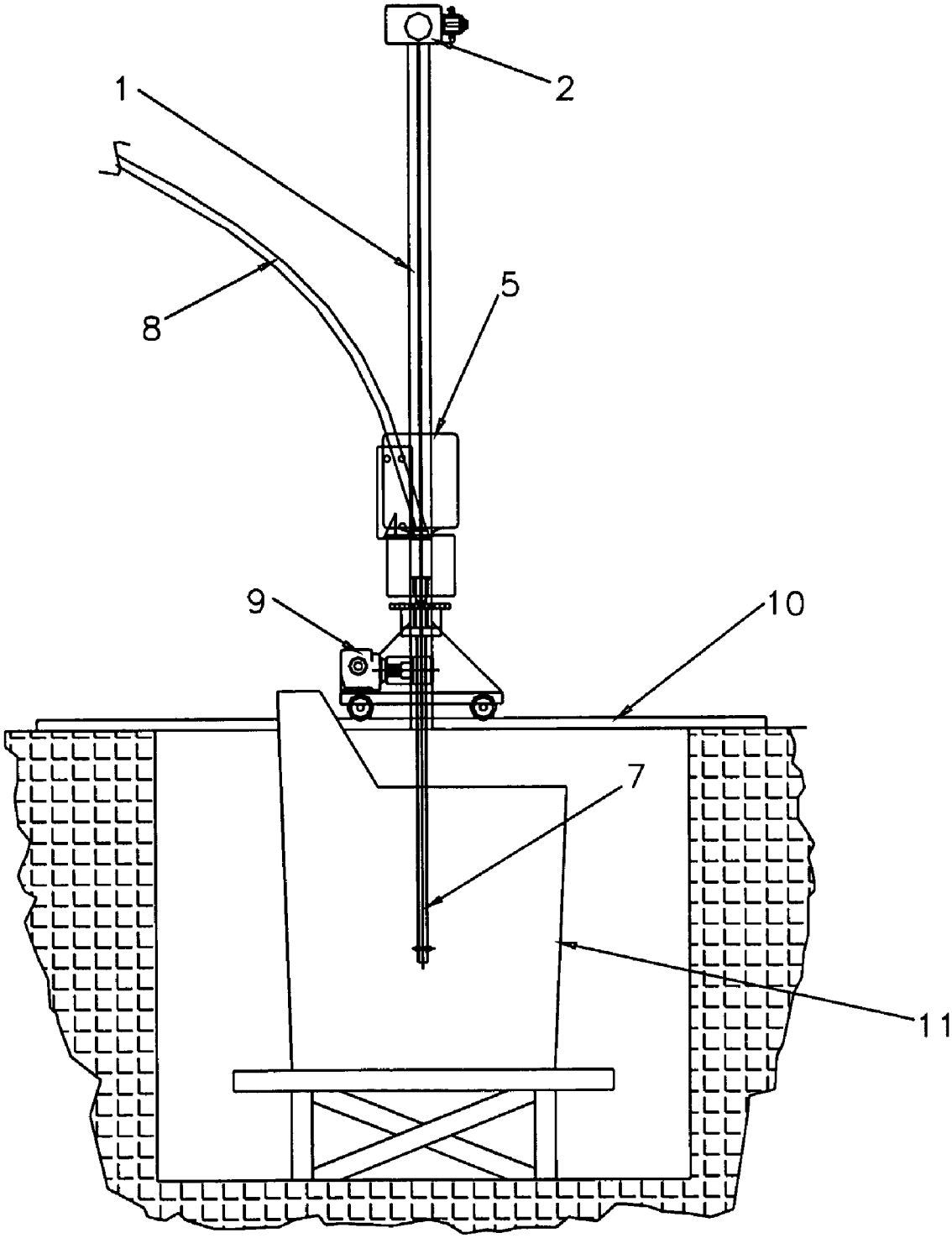
FIG. 2 shows the system side view with the pit in section.

The rotating blowing test consists of transforming electric energy into mechanical energy to obtain circular movements, motion, and elevation.

The system consists of a couple of porticos (1) with an elevation system, activated by a motor-reducer set (2) that activates a chain linked to a couple of toothed wheels (3), promoting a rectilinear uniform movement that is capable of lifting or lowering cargo.

A horizontal girder (4) links the two columns of the porticos (1). Those porticos, connected to another motor-reducer set (5), are able to transform electrical energy into circular mechanical movement. It is controlled by a frequency inverter, which provides the rotative regulation of the lance (7) that will be immersed into the liquid metal through the descending motion of the portico system (1).

The system has a rotative junction (6) that allows it to be linked to a powder and/or gas injection hose (8) to avoid it rotating with the lance (7).

The powder gets close to the lance (7) through a hose (8) that is linked on its upper part through this rotative junction (6). The lance (7) is refractory having two orifices on the other extremity to inject the powder on the bottom of the recipient (11) in accordance with the figures of the present invention.

The system has two other motor-reducer sets (9) that are able to perform a horizontal motion of the porticos (1). They slide over the rails installed on the superior floor (10), allowing the set to dislocate to the center, above the recipient (11), and return to a safe position to be taken from the pit.

The system starts with the positioning of the recipient (11) on the bottom of the pit through a rolling bridge.

After that, the motor-reducer sets (9) are activated and the system slides over the rails (10) until it reaches the central point of the recipient (11), staying over it.

Later, the second motor-reducer set (2) is activated, and the portico (1) starts to descend the system.

Then the third set (5) is activated and it starts to rotate the lance (7) in low rotation. When the lance extremity (7) reaches the scoria line of the recipient (11) and starts to break that layer, the system starts the injection of powder and gas, gradually increasing the rotation of the lance (7), and continues going down until it reaches a 100 mm distance of the bottom of the recipient (11). The lance (7) rotation has the finality of improving the reaction efficiency and avoiding dead zone, producing an anticlockwise vortex in accordance with the present invention.

When the portico (1) is 100 mm from the bottom of the recipient (11) it starts to raise the system until it reaches the surface of the liquid. As soon as the orifices of the lance (7) are out of the liquid, the mixture injection and the rotation of the lance (7) are broken off automatically.

The portico (1) continues raising the system until it reaches its highest point, and the lance (7) is totally out of the recipient (11).

Later, the motor-reducer sets (9) are activated again. They activate the portico (1) wheels, returning to its initial point.

Having now described the invention in accordance with the requirements of the patent statutes, those skilled in this art will understand how to make changes and modifications in the present invention to meet their specific requirements or conditions. Such changes and modifications may be made without departing from the scope and spirit of the invention as set forth in the following claims.

What is claimed is:

1. A system of injecting gas and/or gas and powders in liquid metals through a rotary refractory lance, comprising:

a couple of porticos (1) with an elevation system, activated by a motor-reducer set (2) that activates a chain linked to a couple of toothed wheels (3), promoting a rectilinear uniform movement that is capable of lifting or lowering cargo; a horizontal girder (4) links two columns of the porticos (1), said porticos connected to another motor-reducer set (5), wherein the motor-reducer set (5) is able to transform electrical energy into circular mechanical movement; said motor-reducer set (5) being controlled by a frequency inverter, which provides the rotative regulation of the lance (7) that will be immersed into the liquid metal through the descending motion of the portico system (1); a rotative junction (6) linked to a powder and/or gas injection hose (8) to avoid rotation with the lance (7); the hose linked on its upper part through the rotative junction (6), which is linked to the upper part of the lance (7), which is lowered into a recipient (11); the recipient (11) positioned on a pit bottom through a rolling bridge, afterwhich the motor-reducer sets (9) are activated and the system slides over the rails (10) until it reaches a central point of the recipient (11); a second motor-reducer set (2) activated so that the portico (1) is motioned vertically downwards; a third motor-reducer set (5) activates and then starts to rotate the lance (7) in low rotation, being that the lance extremity (7) reaches a scoria line of the recipient (11) and starts to break scoria layer; the system starts the injection of powder and gas upon the gradual increasing of the rotation of the lance (7), which is concomitantly vertically motioned downwards until it reaches 100 mm distance of recipient (11) bottom; when the distance of 100 mm between the bottom of the recipient (11) and the extremity of the lance (7) is reached and after the injection of gas and/or powder, said lance starts a vertical movement upwards until liquid surface is reached, while orifices of the lance (7) are out of the liquid, the injection of gas and/or powder and the rotation of the lance (7) are broken off automatically, while the portico (1) raises the system so that the lance (7) is completely out of the recipient (11); the motor-reducer sets (9) are activated again in order to activate the portico (1) wheels to return to an initial point.

* * * * *